US009056320B2

(12) United States Patent
Watahiki et al.

(10) Patent No.: US 9,056,320 B2
(45) Date of Patent: Jun. 16, 2015

(54) CENTRIFUGE INCLUDING DEPRESSURIZATION UNIT AND COOLING UNIT THAT COOPERATE WITH EACH OTHER

(71) Applicant: HITACHI KOKI CO., LTD., Tokyo (JP)

(72) Inventors: Takayuki Watahiki, Hitachinaka (JP); Hiroyuki Takahashi, Hitachinaka (JP)

(73) Assignee: HITACHI KOKI CO., LTD., Tokyo (JP)

( * ) Notice: Subject to any disclaimer, the term of this patent is extended or adjusted under 35 U.S.C. 154(b) by 150 days.

(21) Appl. No.: 13/745,179

(22) Filed: Jan. 18, 2013

(65) Prior Publication Data

US 2013/0190159 A1 Jul. 25, 2013

(30) Foreign Application Priority Data

Jan. 24, 2012 (JP) ..... 2012-011669

(51) Int. Cl.

| | |
|---|---|
| ***B04B 9/10*** | (2006.01) |
| ***B04B 13/00*** | (2006.01) |
| ***B04B 15/02*** | (2006.01) |
| ***B04B 15/08*** | (2006.01) |

(52) U.S. Cl.

CPC . *B04B 15/02* (2013.01); *B04B 9/10* (2013.01); *B04B 13/00* (2013.01); *B04B 15/08* (2013.01)

(58) Field of Classification Search

USPC ..... 494/1, 7–10, 11, 13, 14, 16–21, 60, 61, 494/84

See application file for complete search history.

(56) References Cited

U.S. PATENT DOCUMENTS

| | | | | | |
|---|---|---|---|---|---|
| 3,327,938 | A * | 6/1967 | Stallmann | 494/15 |
| 3,409,212 | A * | 11/1968 | Durland et al. | 494/1 |
| 4,857,811 | A * | 8/1989 | Barrett et al. | 318/3 |
| 4,941,866 | A * | 7/1990 | Gorodissky et al. | 494/14 |
| 4,952,370 | A * | 8/1990 | Cummings et al. | 422/28 |
| 5,431,620 | A * | 7/1995 | Schenck et al. | 494/7 |
| 6,682,631 | B2 * | 1/2004 | Cole | 159/6.1 |
| 6,817,970 | B2 * | 11/2004 | Berit et al. | 494/29 |
| 6,866,621 | B1 * | 3/2005 | Muller et al. | 494/7 |
| 8,409,068 | B2 * | 4/2013 | Akatsu et al. | 494/1 |
| 8,529,424 | B2 * | 9/2013 | Takahashi | 494/7 |
| 8,852,069 | B2 * | 10/2014 | Haruki et al. | 494/1 |
| 2011/0021332 | A1 * | 1/2011 | Akatsu et al. | 494/1 |
| 2011/0059835 | A1 * | 3/2011 | Takahashi | 494/10 |
| 2012/0260687 | A1 * | 10/2012 | Inaniwa et al. | 62/196.1 |

(Continued)

FOREIGN PATENT DOCUMENTS

| | | | | |
|---|---|---|---|---|
| JP | 9-024302 | A | 1/1997 | |
| JP | 2002113391 | A * | 4/2002 | B04B 9/10 |

(Continued)

*Primary Examiner* — Charles Cooley

(74) *Attorney, Agent, or Firm* — McDermott Will & Emery LLP

(57) ABSTRACT

A centrifuge capable of suppressing a long-time depressurization as compared with the case of starting depressurizing after cooling has been completed as well as shortening a cooling time of a rotor and a sample in the rotor is achieved as compared with the case of starting cooling is at the same time with depressurization. Operation of a Peltier element is started at the same time with operation start of the centrifuge. A bowl is cooled by heat absorption of the Peltier element, and the rotor is cooled by the bowl with using ambient air as a thermal medium. At this time, a vacuum pump depressurizing a rotor chamber is in an OFF state (ambient conditions). After a predetermined time is elapsed, the vacuum pump is turned on to start depressurization of the inside of the rotor chamber.

12 Claims, 4 Drawing Sheets

(56) References Cited

U.S. PATENT DOCUMENTS

| | | | | |
|---|---|---|---|---|
| 2013/0184140 | A1* | 7/2013 | Haruki et al. | 494/7 |
| 2013/0190159 | A1* | 7/2013 | Watahiki et al. | 494/11 |
| 2014/0024516 | A1* | 1/2014 | Kusumoto et al. | 494/1 |
| 2014/0031191 | A1* | 1/2014 | Inaniwa et al. | 494/9 |
| 2014/0349826 | A1* | 11/2014 | Haruki | 494/1 |

FOREIGN PATENT DOCUMENTS

| | | | |
|---|---|---|---|
| JP | 2008023477 | A * | 2/2008 |
| JP | 2009195875 | A * | 9/2009 |
| JP | 2009268980 | A * | 11/2009 |
| JP | 2010058089 | A * | 3/2010 |
| JP | 2010104944 | A * | 5/2010 |
| JP | 2010131560 | A * | 6/2010 |
| JP | 2010131585 | A * | 6/2010 |
| JP | 2010201380 | A * | 9/2010 |
| JP | 2010201403 | A * | 9/2010 |
| JP | 2011139976 | A * | 7/2011 |
| JP | 2011177703 | A * | 9/2011 |
| JP | 2012152718 | A * | 8/2012 |

* cited by examiner

CENTRIFUGE INCLUDING DEPRESSURIZATION UNIT AND COOLING UNIT THAT COOPERATE WITH EACH OTHER

CROSS-REFERENCE TO RELATED APPLICATION

The present application claims priority from Japanese Patent Application No. 2012-011669 filed on Jan. 24, 2012, the content of which is hereby incorporated by reference into this application.

TECHNICAL FIELD OF THE INVENTION

The present invention relates to a centrifuge which centrifuges a sample. Particularly, the present invention relates to a centrifuge having a function of cooling down a rotor holding the sample and a function of depressurizing a rotor chamber.

BACKGROUND OF THE INVENTION

In a centrifuge, generally, a sample stored in a tube or a bottle is housed within a rotor, and separation and refinement or the like of the sample rotating together with the rotor are performed by the rotor being rotated at a high speed by a driving device such as a motor in a rotor chamber (rotation chamber) sealed by a door.

A rotation speed of the rotor differs depending on usage, and a family of products having a wide range of rotation speeds from one having a comparative low-speed where the maximum rotation speed is about several thousands of rpm (revolutions per minute) to one having a high-speed of 150,000 rpm has been generally provided. Among them, a centrifuge having a rotor and the rotor's rotation speed substantially exceeding 40,000 rpm (hereinafter, referred to as a "ultracentrifuge") is provided with a vacuum pump which depressurizes a rotor chamber to suppress a temperature rise of the rotor and a sample in the rotor due to friction heat between air in the rotor chamber and the rotor. In this way, in the ultracentrifuge, since an operation thereof is performed by depressurizing the rotor chamber, the friction with air becomes small.

In Patent Document 1 shown in the following, disclosed is a technology of achieving shortening of a cooling time of the rotor by carrying out rotation at a low speed until the rotor temperature reaches a desired temperature, and carrying out acceleration up to a configured rotation speed after reaching the desired temperature.

Under a depressurized environment, since heat exchange based on radiation becomes dominant rather than heat exchange based on convection, cooling of a rotor and a sample in the rotor takes time as compared with a state under a non-depressurized environment (for example, under an atmospheric pressure environment). From this, in the case of using a sample which must be handled at a low temperature, the rotor and sample are cooled in a coolerator or the like in advance, or are cooled within the centrifuge for a long time. In this manner, there is a trade-off relation between friction heat reduction based on depressurizing in the rotor chamber and shortening of the cooling time of the rotor and a sample in the rotor in the rotor chamber. Even if the rotor rotates at a low speed until the temperature of the rotor reaches a desired temperature as shown in Patent Document 1, a cooling time can be shortened little under the depressurized environment where the heat exchange based on radiation is dominant, and a long time is required for a rotor temperature to reach the desired temperature.

On the other hand, although the cooling of the rotor and a sample in the rotor becomes quicker due to the air convection if the inside of the rotor chamber is cooled in a state of an atmospheric pressure, the inside of the rotor chamber dews or freezes and thus it takes a long time for the depressurization. That is, if there is dew water or ice, the dew water or ice must be evaporated when depressurizing the inside of the rotor chamber with a vacuum pump operated. Therefore, there has been a problem that it takes an excessive time until a degree of vacuum in the rotor chamber reaches high vacuum, and a long time is required until the rotor is rotated at a high speed.

SUMMARY OF THE INVENTION

The present invention has been made based on recognition of such a situation. A preferred aim of the present invention is to provide a centrifuge capable of suppressing a long-time depressurization as well as shortening a cooling time of a rotor and a sample in the rotor compared with a case where cooling is started concurrently with depressurizing.

A centrifuge of an embodiment includes: a rotor holding a sample to be subjected to a separation; a rotor chamber in which the rotor is housed; a cooling unit for cooling the rotor; a driving unit which rotates the rotor; a depressurization unit for depressurizing an inside of the rotor chamber; a temperature sensor detecting a temperature of the rotor chamber or the rotor; a control unit for controlling the cooling unit, the driving unit and the depressurization unit. The control unit cools the inside of the rotor chamber without operating the depressurization unit until a predetermined time elapses after cooling by the cooling unit is started, operates the depressurization unit after the predetermined time has elapsed, and depressurizes the inside of the rotor chamber in parallel with cooling by the cooling unit.

A centrifuge of another embodiment includes: a rotor holding a sample to be subjected to a separation; a rotor chamber in which the rotor is housed; a cooling unit for cooling the rotor; a driving unit for rotating the rotor; a depressurization unit for depressurizing an inside of the rotor chamber; a temperature sensor detecting temperature of the rotor chamber or the rotor; a control unit for controlling the cooling unit, the driving unit and the depressurization unit. The control unit cools the inside of the rotor chamber without operating the depressurization unit until a temperature detected by the temperature sensor reaches a predetermined value after cooling by the cooling unit is started, operates the depressurization unit after a temperature detected by the temperature sensor reaches the predetermined value, and depressurizes the inside of the rotor chamber in parallel with cooling by the cooling unit.

According to the present invention, cooling by the cooling unit is started before the operation of the depressurization unit is started, and after that, the depressurization unit is operated, and the inside of the rotor chamber is depressurized in parallel with cooling by the cooling unit. Therefore, while shortening of the cooling time of the rotor and a sample in the rotor is achieved as compared with a case where cooling is started concurrently with depressurizing, a long-time depressurization can be suppressed. In this manner, it becomes possible to more quickly cool a sample in the rotor to a desired temperature to separate it.

BRIEF DESCRIPTIONS OF THE DRAWINGS

DESCRIPTIONS OF THE PREFERRED EMBODIMENTS

Figure 1:
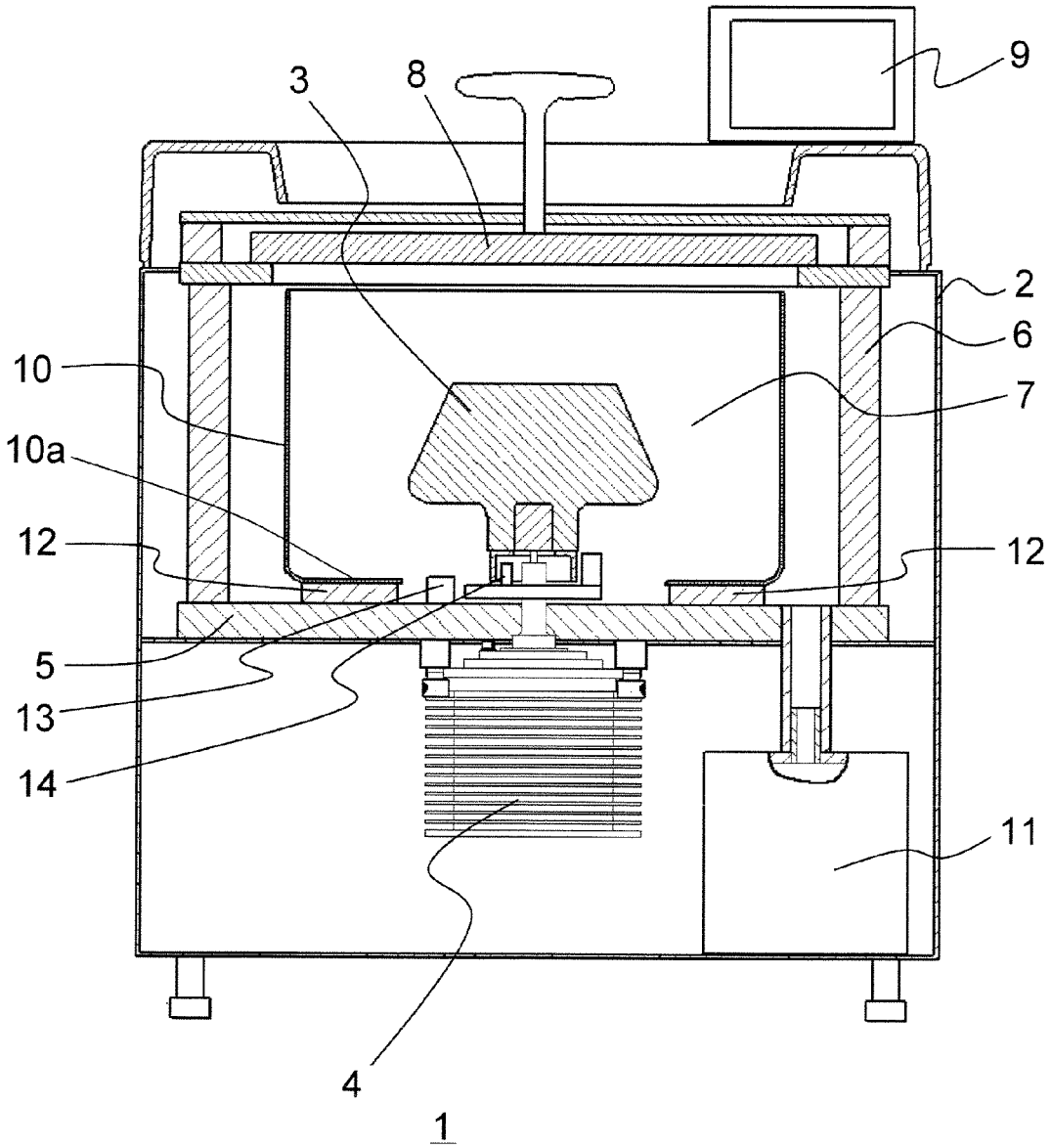
FIG. 1 is a cross-cross-sectional view illustrating a structure of a whole centrifuge according to an embodiment of the present invention.

Hereinafter, embodiments of the present invention will be described in detail with reference to the accompanying drawings. Note that the same or similar components, parts, process etc. illustrated in the drawings are denoted by the same reference symbols throughout the drawings for describing the embodiment, and the repetitive description thereof will be omitted. Also, the embodiments are described as examples and they are not limiting the invention. All the features and combinations of the features described in the embodiments are not always essential to the invention.

Figure 2:
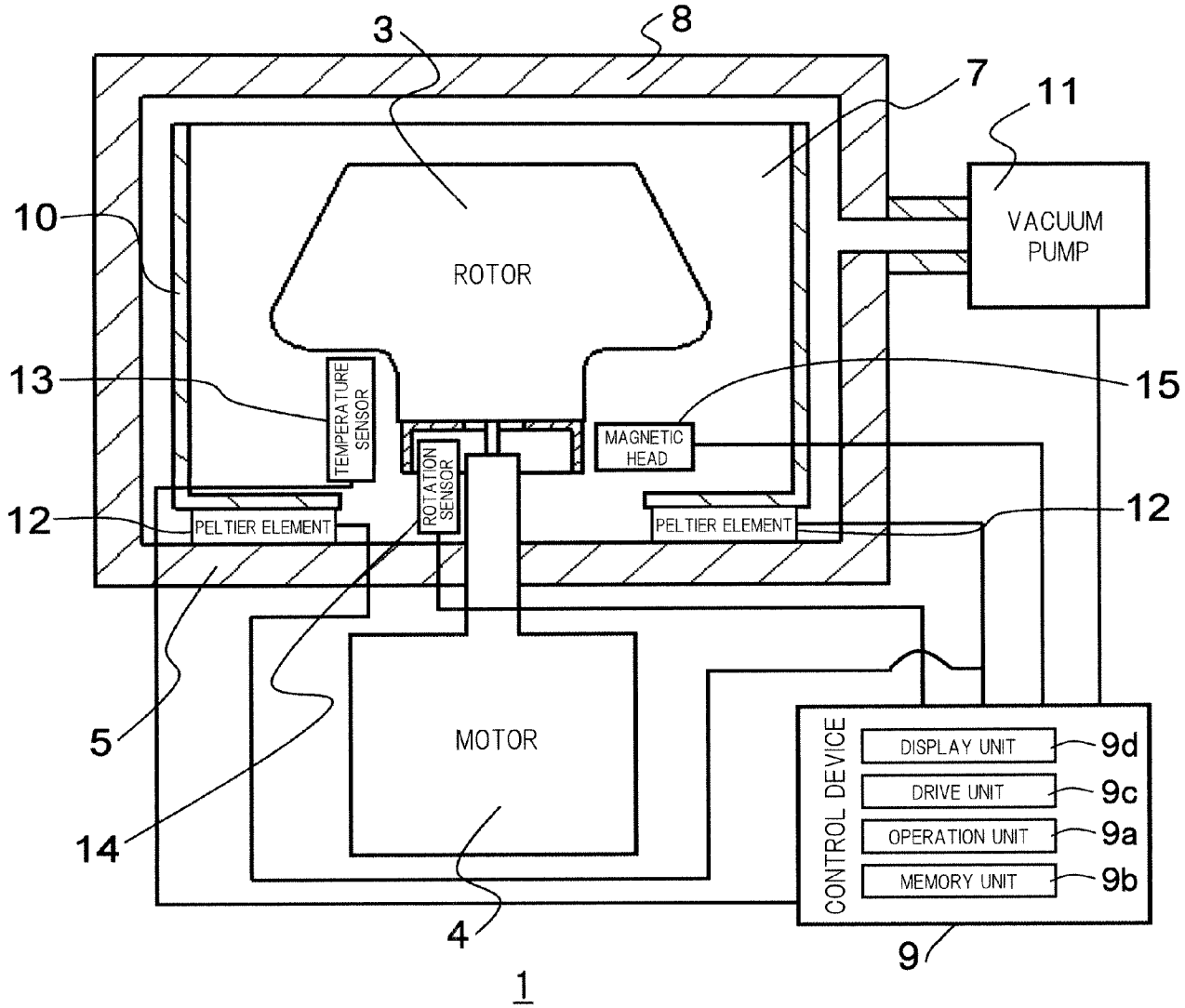
FIG. 2 is a functional block diagram of the centrifuge illustrated in FIG. 1.
Figure 3:
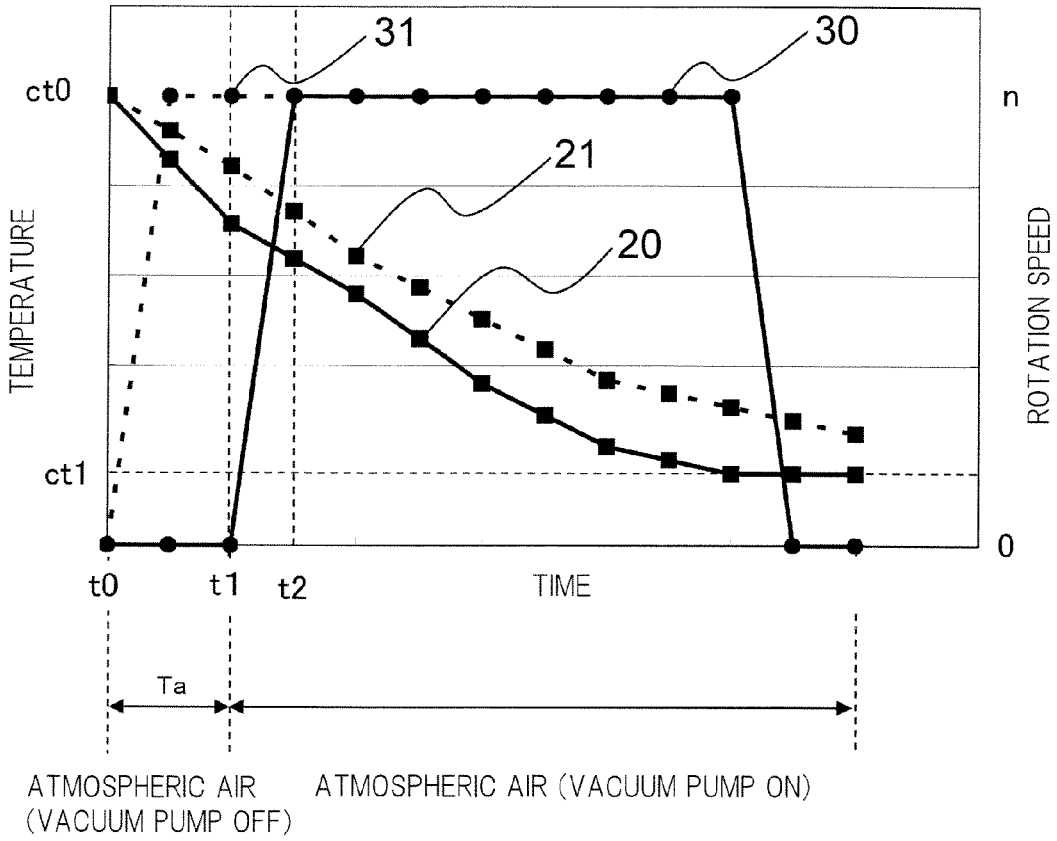
FIG. 3 is a time chart illustrating a rotor cooling state and a rotation speed based on an ambient-air pre-cooling operation mode and normal operation mode of the centrifuge illustrated in FIG. 1.
Figure 4:
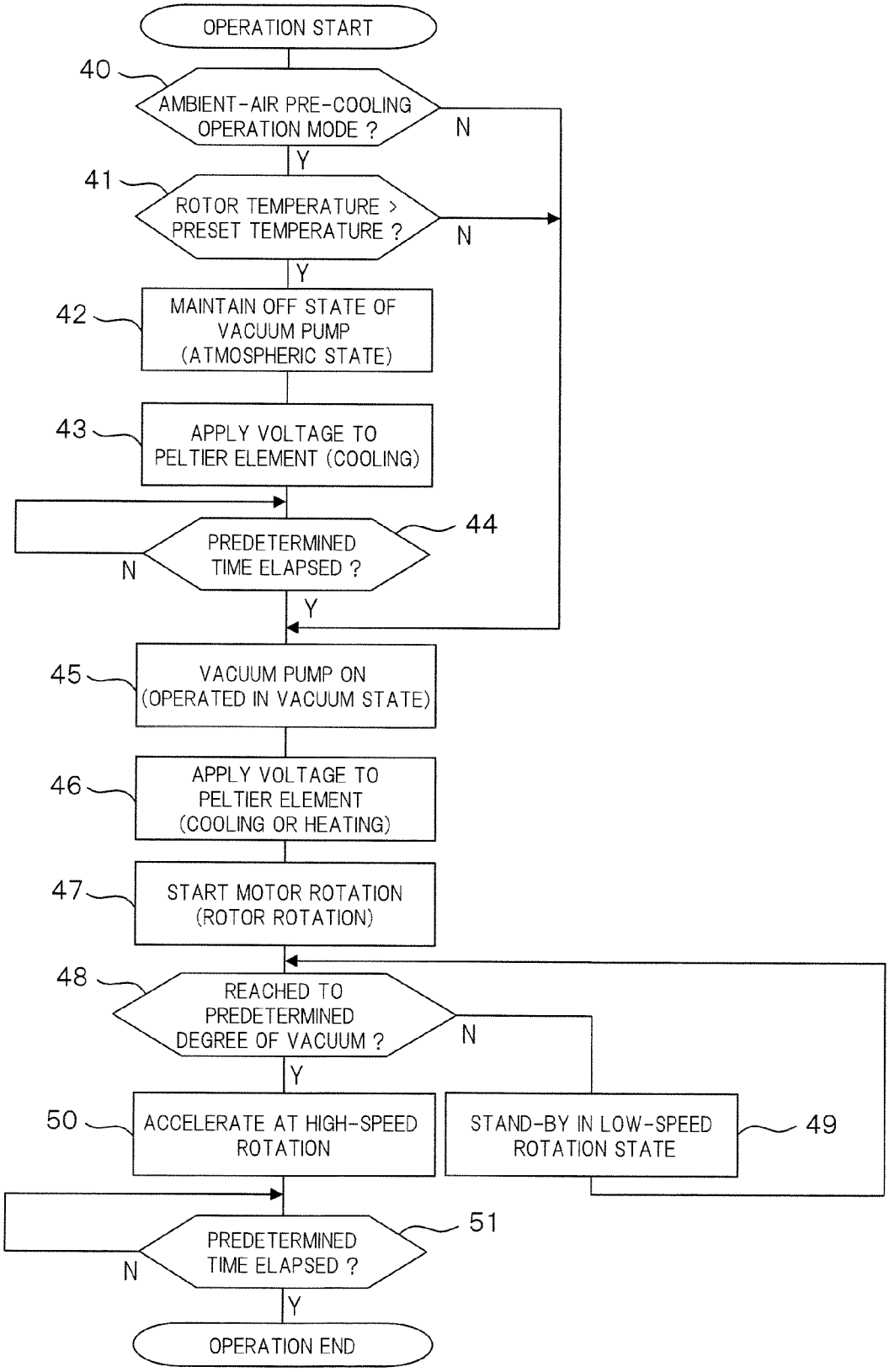
FIG. 4 is a flow chart illustrating an operation procedure of the ambient-air pre-cooling operation mode of the centrifuge shown in FIG. 1.

FIG. 1 is a cross-sectional view illustrating an entire structure of a centrifuge 1 according to an embodiment of the present invention. FIG. 2 is a functional block diagram of the centrifuge 1 illustrated in FIG. 1. FIG. 3 is a time chart illustrating a cooling state and rotation speed of the rotor based on an ambient-air pre-cooling operation mode and normal operation mode of the centrifuge 1 illustrated in FIG. 1. FIG. 4 is a flow chart illustrating an operation procedure of the ambient-air pre-cooling operation mode of the centrifuge 1 illustrated in FIG. 1.

First, an entire configuration of the centrifuge 1 will be described with reference to FIG. 1. The centrifuge 1 is provided with a chassis (frame) 2 having a cross-section shape viewed from an upper-surface of a substantial quadrangle, and in the inside of the chassis 2, is provided with a rotor 3 made from a titanium alloy or an aluminum alloy or the like for holding a sample container (not illustrated) such as a tube, a motor 4 as a driving unit for giving a rotation driving force to the rotor 3, and a rotor chamber (rotation chamber) 7 which is partitioned by a bottom member 5 (plate) and a circular partition member 6 and houses the rotor 3. In addition, at an upper opening part (opening and closing part) of the rotor chamber 7 formed in the chassis 2, a door 8 of a sliding type as an opening and a closing unit is openably attached to the chassis 2.

During rotation of the rotor 3, the door 8 is controlled by a control device 9 (for example, a microcomputer) described later so as to keep the rotor chamber 7 airtight and not to be opened. The inside of the rotor chamber 7 is depressurized to about 1 Pa or less by a vacuum pump 11 as a depressurization unit which operates during an operation of the rotor 3. This depressurization enables reduction of heat generation due to friction between the rotating rotor 3 and air remaining in the rotor chamber 7.

In the rotor chamber 7, a bowl 10 made from an aluminum material, for example, is installed so as to enclose the rotor 3. A Peltier element 12 for temperature control (exemplification of cooling unit) is sandwiched between a bottom part 10*a* of the bowl 10 and the bottom member 5. Temperature of the rotor chamber 7 is detected by a temperature sensor 13 fixed to the bottom member 5, and is measured by the control device 9. The cold of the Peltier element 12 (refer to FIG. 2) controlled by the control device 9 is immediately transferred to the whole rotor chamber 7 via the bowl 10 formed of a material having a high thermal conductivity to control the temperature of the rotor chamber 7 uniformly at 4° C., for example. Consequently, a temperature rise due to a windage loss during rotation of the rotor 3 is suppressed by depressurization, and heat of the rotor 3 is taken away by radiation, and the temperature in the rotor 3 is controlled at a constant temperature in spite of high-speed rotation.

As illustrated in the functional block diagram of FIG. 2, the Peltier element 12 and the temperature sensor 13 are electrically connected to the control device 9, and the control device 9 compares a detected value from the temperature sensor 13 with a temperature setting value previously set in the control device 9, and applies or stops applying an on/off-controlled driving voltage to the Peltier element 12 so as to cool the Peltier element 12 based on the calculation result. The motor 4 is constituted of an induction motor, for example. A driving power source of this motor 4 is driven by a three-phase alternating current power source with a commercial alternating current power source (for example, 100V or 200V, 50/60 Hz) converted via an inverter, thereby giving high-speed rotation to the rotor 3. A rotation speed of the rotor 3 rotated by the motor 4 is detected by a rotation sensor 14 provided close to a bottom part of the rotor 3. The detected value of the rotation sensor 14 is inputted into the control device 9, and the control device 9 compares the detected value with a rotation speed setting value previously set in the control device 9, and controls a rotation speed of the motor 4 while carrying out the calculation. A magnetic head 15 reads information of the rotor 3 side, and inputs the information into the control device 9 in order to identify a type or the like of the rotor 3.

The control device 9, as shown in FIG. 2, includes a microcomputer including an operation unit 9*a* and a memory unit 9*b*, and further provided with a drive unit 9*c* including a drive circuit of the motor 4, a drive circuit of the vacuum pump 11, and a drive circuit of the Peltier element 12. In addition, the control device 9 is provided with an operation panel for inputting, into the control device 9, data indicating the rotation speed of the rotor 3 and operation conditions such as a time and a temperature with which centrifuging is carried out, and with a display unit 9*d* for displaying the inputted information and monitoring information during an operation. The memory unit 9*b* of the control device 9 is provided with a memory like a ROM or the like storing data such as a control program of the motor 4, a control program of the vacuum pump 11, a control program of the Peltier element 12 and/or the like.

In the centrifuge 1 having configurations described above, an ambient-air pre-cooling operation mode according to the present embodiment will be described with reference to a time chart illustrated in FIG. 3.

At the same time as the operation is started at the time t0, the Peltier element 12 also starts operation. At this time, the control device 9 measures a temperature of the rotor 3 all the time with the temperature sensor 13, compares the measured value with a preset temperature configured in advance by a user in the control device 9, and carries out a control by applying a voltage (pulse voltage turned on/off with a predetermined period) to the Peltier element 12 from the control device 9 so that the temperature of the rotor 3 may turn into the preset temperature. When the temperature of the rotor 3 is higher than the preset temperature, the bowl 10 is cooled by heat absorption of the Peltier element 12, and the rotor 3 is cooled by the bowl 10 with ambient air as a heat medium. Thereby, the rotor temperature begins to descend gradually from ct0 which is a temperature at the time of the operation start as indicated by rotor temperature transition data 20. At this time, the rotation speed of the motor 4 is a stopped state, i.e., 0 rpm as indicated by rotation speed transition data 30, and the vacuum pump 11 depressurizing the rotor chamber 7 is in an OFF state (ambient air state).

A time Ta is such a time as dew water adheres slightly to a surface of the bowl 10 when the rotor chamber 7 is cooled in ambient conditions. Upon reaching a time t1 when the time Ta has elapsed from cooling start, the vacuum pump 11 is turned ON and depressurization of the inside of the rotor chamber 7 is started, and as for the rotation speed, as indicated by rotation speed transition data 30, the motor 4 is accelerated up to the rotation speed 'n' rpm which is desired by a user, and is stabilized after the time reaches a time t2. Note that a timing at which the vacuum pump 11 is turned ON may be set as an elapsed time until a predetermined temperature difference arises when the inside of the rotor chamber 7 is cooled in ambient conditions. Besides, the time Ta is 10 minutes to several tens of minutes, for example, and can be optionally set by a user in advance in the control device 9.

On the other hand, rotor temperature transition data 21 and rotation speed transition data 31 are based on a conventional operation, where concurrently with the operation start, the vacuum pump 11 is made to be turned ON and the inside of the rotor chamber 7 is made to be depressurized and the motor 4 is made to be accelerated up to the rotation speed n rpm which is desired by a user. Although the bowl 10 is cooled by the Peltier element 12 in the same way as the above-described ambient-air pre-cooling operation mode, since the rotor 3 is cooled in a state where radiation to the bowl 10 is dominant since air to be a thermal medium is thin, it takes more time to cool the rotor 3 as compared with the ambient-air pre-cooling operation mode.

By setting a time until dew formation starts as a predetermined time when the inside of the rotor chamber 7 is cooled in ambient conditions, pre-cooling the inside of the rotor chamber 7 in ambient conditions until the time elapses after the cooling start, and depressurizing the inside of the rotor chamber 7 to rotate the rotor up to the set rotation speed after the predetermined time has elapsed, a preset temperature ct1 set by a user in advance in the control device 9 is reached faster.

Next, an operation procedure of the ambient-air pre-cooling operation mode according to the present embodiment will be described based on a flow chart of FIG. 4.

The operation is started by a user depressing a switch "START SW" (not illustrated). In Step 40, it is determined whether an operation mode is the ambient-air pre-cooling operation mode of the present embodiment, or a conventional mode (normal operation mode) where the ambient-air pre-cooling operation is not performed. Changeover-settings between the ambient-air pre-cooling operation mode and the conventional mode are selected by the user in a menu screen of the display unit 9*d* of the control device 9, and a result is assumed to have been stored in the memory unit 9*b* in advance. In the case of the conventional mode, a step shifts to Step 45, where a conventional control is performed. In the ambient-air pre-cooling operation mode, when a temperature of the rotor 3 calculated from the temperature sensor 13 is not higher than a preset temperature (preset temperature ct1 set in the control device 9 in advance by the user) in Step 41, the step is shifted to Step 45 and the conventional control is performed to heat the rotor chamber 7. When the temperature of the rotor 3 calculated from the temperature sensor 13 is higher than the preset temperature (preset temperature ct1 set in the control device 9 in advance by the user), the ambient-air pre-cooling operation is started. First, in Step 42, ambient conditions is kept with the vacuum pump 11 maintained in an OFF state.

Then, in Step 43, a voltage is applied to the Peltier element 12, and a temperature of the bowl 10 is reduced and the rotor 3 is cooled. In Step 44, it is waited for a predetermined time to elapse after starting of the ambient-air pre-cooling operation mode. After the predetermined time has elapsed, in Step 45, the vacuum pump 11 is turned on, and the inside of the rotor chamber is depressurized. In Step 46, a voltage is applied to the Peltier element 12, and heating/cooling of the rotor chamber 7 are performed from the state of the rotor temperature calculated from the temperature sensor 13 and the preset temperature (preset temperature ct1 set in the control device 9 in advance by the user). In Step 47, rotation of the motor 4 is started to drive the rotor 3 to rotate. In Step 48, it is waited for the inside of the rotor chamber 7 to reach a predetermined degree of vacuum, and when the predetermined degree of vacuum has not been reached, stand-by is maintained in a state of low speed rotation in Step 49.

When the inside of the rotor chamber 7 has reached the predetermined degree of vacuum, in Step 50, acceleration is carried out up to the rotation speed configured in the control device 9 in advance by a user. In Step 51, when an operation time set in the control device 9 in advance by the user has elapsed, the operation is finished, and the speed is slowed down to stop the rotor 3.

Note that, in Step 44, the process of waiting for the predetermined time to elapse may be variable using a predetermined calculation based on a room temperature, a rotor temperature and a preset temperature previously set in the control device 9 by the user, or the like. In addition, in Step 43, while a voltage is applied to the Peltier element 12, and rotation of the motor 4 is started, and cooling is carried out in ambient conditions, the rotor 3 may be rotated at a speed (such a low speed as the windage loss does not exert an influence upon the rotor 3) lower than the configured rotation speed 'n' rpm after the operation start of the vacuum pump 11. In this manner, a heat exchange based on the convection is increased, and it is possible to cool the rotor 3 faster. Furthermore, a rotation speed of the rotor 3 during cooling in ambient conditions may be made to be variable.

When the centrifuge 1 according to the present embodiment is used in place of a coolerator as a unit for cooling the rotor 3 in advance, if the motor 4 in Step 47 is not started to rotate and is cooled while it is stopped, cooling of the rotor 3 becomes faster and effective since there is no heat generation of the motor 4.

According to the present embodiment, the following effects can be achieved. After the operation is started, cooling by means of the Peltier element 12 is carried out first without making the vacuum pump 11 operate, and after that, before a temperature of the rotor 3 descends to the preset temperature ct1 (within a period in which the dew formation in the rotor chamber 7 does not exist or is little, for example), the vacuum pump 11 is operated for depressurization to be started, and cooling by the Peltier element 12 and depressurizing by the vacuum pump 11 are carried out in parallel. Therefore, while shortening of a cooling time of the rotor 3 and a sample in the rotor 3 is achieved as compared with the case where cooling is started concurrently with depressurizing, it is possible to suppress the situation that the depressurization time becomes long as compared with the case where depressurizing is started after cooling down to the preset temperature ct1 has been completed. In this manner, it becomes possible make it faster to cool a sample in the rotor 3 into a desired temperature and to separate it. Shortening a cooling time enables the cooling to be substituted by cooling in a coolerator, and potential needs from a user are large.

As described above, although the present invention has been described with embodiments as examples, it is understood by a person skilled in the art that various modifications are applicable to each of constituents and processing processes of the embodiments within a scope of the invention recited in the claims.

What is claimed is:

1. A centrifuge comprising:

a rotor holding a sample to be separated;

a rotor chamber in which the rotor is housed;

a cooling unit for cooling the rotor;

a driving unit for rotating the rotor;

a depressurization unit for depressurizing an inside of the rotor chamber;

a temperature sensor detecting a temperature of the rotor chamber or the rotor; and a control unit for controlling the cooling unit, the driving unit and the depressurization unit, wherein the control unit cools the inside of the rotor chamber without operating the depressurization unit until a predetermnined time elapses after cooling by the cooling unit is started, operates the depressurization unit after the predetermined time has elapsed, and depressurizes the inside of the rotor chamber in parallel with cooling by the cooling unit.

2. The centrifuge according to claim 1, wherein the control unit starts an operation of the depressurization unit before dew formation or freezing occurs in the rotor chamber.

3. The centrifuge according to claim 1, wherein the control unit can carry out, based on a selection in an operation part, a normal mode of starting cooling by the cooling unit and depressurization by the depressurization unit at the same time.

4. The centrifuge according to claim 1, wherein a time after cooling by the cooling unit is started until an operation of the depressurization unit is started is optionally settable.

5. The centrifuge according to claim 1, wherein the driving unit rotates the rotor at a rotation speed lower than a configured rotation speed while the control unit controls the cooling unit to cool the inside of the rotor chamber without operating the depressurization unit, the configured rotation speed being a speed set by a user and used after the depressurization unit starts depressurizing the inside of the rotor chamber.

6. The centrifuge according to claim 5, wherein the rotation speed lower than the configured rotation speed is variable.

7. A centrifuge comprising:

a rotor holding a sample to be separated;

a rotor chamber in which the rotor is housed;

a cooling unit for cooling the rotor;

a driving unit for rotating the rotor;

a depressurization unit for depressurizing an inside of the rotor chamber;

a temperature sensor detecting a temperature of the rotor chamber or the rotor; and a control unit for controlling the cooling unit, the driving unit and the depressurization unit, wherein the control unit cools the inside of the rotor chamber without operating the depressurization unit until a temperature detected by the temperature sensor reaches a predetermined value after cooling by the cooling unit is started, operates the depressurization unit after a temperature detected by the temperature sensor reaches the predetermined value, and depressurizes the inside of the rotor chamber in parallel with cooling by the cooling unit.

8. The centrifuge according to claim 7, wherein the control unit starts an operation of the depressurization unit before dew formation or freezing occurs in the rotor chamber.

9. The centrifuge according to claim 7, wherein the control unit can carry out, based on a selection in an operation part, a normal mode of starting cooling by the cooling unit and depressurization by the depressurization unit at the same time.

10. The centrifuge according to claim 7, wherein a time after cooling by the cooling unit is started until an operation of the depressurization unit is started is optionally settable.

11. The centrifuge according to claim 7, wherein the driving unit rotates the rotor at a rotation speed lower than a configured rotation speed while the control unit controls the cooling unit to cool the inside of the rotor chamber without operating the depressurization unit, the configured rotation speed being a speed set by a user and used after the depressurization unit starts depressurizing the inside of the rotor chamber.

12. The centrifuge according to claim 11, wherein the rotation speed lower than the configured rotation speed is variable.

* * * * *